United States Patent [19]

Langevin et al.

[11] Patent Number: 5,020,245

[45] Date of Patent: Jun. 4, 1991

[54] STEAM SHOWER VACUUM APPARATUS

[75] Inventors: Eric T. Langevin, Northboro; Austin L. Carter, Jr., Sutton; Michael J. Van Kleeck, Southbridge, all of Mass.; Bruce E. Taylor, San Jose, Calif.

[73] Assignee: Thermo Electron Web Systems, Inc., Auburn, Mass.

[21] Appl. No.: 339,973

[22] Filed: Apr. 18, 1989

[51] Int. Cl.[5] ..... F26B 13/00

[52] U.S. Cl. ..... 34/155; 34/16

[58] Field of Search ..... 34/16, 23, 92, 155, 34/156, 117, 160

[56] References Cited

U.S. PATENT DOCUMENTS 2,109,087 2/1938 Goodings ..... 34/16 X 2,944,291 7/1960 Prior et al. ..... 34/16 X 4,358,900 11/1982 Dove ..... 34/155 X

*Primary Examiner*—Henry A. Bennett

*Attorney, Agent, or Firm*—Lorusso & Loud

[57] ABSTRACT

An apparatus for removing excess steam from an area around a web, such as paper, the apparatus having a stationary vacuum pick-up slot positioned adjacent the web, a steam exhaust pipe leading from the pick-up slot to a vacuum header, an adjustable opening in the exhaust pipe in the vacuum header, facilitating control of the vacuum across the pick-up slot, and a chamber adapted to be heated, the chamber being configured so as to form one wall of the pick-up slot, and means for maintaining a vacuum on the header and the pick-up slot.

13 Claims, 1 Drawing Sheet

STEAM SHOWER VACUUM APPARATUS

BACKGROUND OF THE INVENTION

This invention relates to papermaking, and more particularly to an apparatus for collecting excess steam to prevent condensation and unacceptable humidity levels at the surface of a sheet.

In the production of paper, steam is often applied to the paper to influence such properties as moisture content, temperature and surface finish. Devices that accomplish this are commonly known in the industry as "steam showers." Such devices span the width of a paper machine and apply steam to a web via impingement, or parallel Coanda principal techniques, at proper locations along the machine. Examples of these types of machines are found in U.S. Pat Nos. 4,685,221 and 4,689,895 whose disclosures are incorporated by reference herein. Application of steam from such devices can be uniform across the machine width or in independently controlled segments.

Steam heating (in the case of a paper web) is never 100% efficient, therefore, there is always excess uncondensed steam which must be exhausted from the region of application. If the excess steam is allowed to freely exhaust into the surrounding atmosphere, it may condense on machine supports and structures, forming droplets which may drip on the paperweb and adversely affect the quality of the paper. In addition, such excess steam may raise ambient humidity to unacceptable levels, creating problems and malfunctions in other equipment as well as discomfort to human operators.

Such excess uncondensed steam may arise in localized regions across the width of the paper machine as a result of strong localized air currents created by rotating machine parts, the use of varying steam flows across the machine width, or uneven condensing rates across the machine width arising from uneven initial web temperatures and resultant heat transfer rates.

To solve the above problems, steam showers often employ exhaust headers on one or both longitudinal edges of the steam shower. Typically, such exhaust devices do not provide for localized vacuum control in the cross-machine direction. Moreover, the web exhaust steam is prone to drip back on the sheet as partial condensation of the steam occurs on the surface of the exhaust device. Furthermore, due to the inevitable entrainment of air from outside the steam shower, depressed exhaust chamber structural surface temperatures lead to condensation of the steam on the exterior surfaces of the machine which eventually leads to water dripping on the web.

SUMMARY OF THE INVENTION

According to the present invention, a steam-shower vacuum apparatus is provided for removing excess steam that has been applied to the surface of a web or sheet. The apparatus includes a vacuum exhaust which is connected through feed ducts to a stationary vacuum pick-up slot or nozzle. The vacuum pick-up slot extends across the sheet and is positioned adjacent and perpendicular to the sheet. The vacuum pick-up slot removes the excess steam as a flow is created through the slot due to the vacuum. The steam is then exhausted away from the sheet, preventing condensation of the steam on the machine parts.

In a preferred embodiment a steam chamber is positioned adjacent the vacuum pick-up slot. The steam chamber is heated to prevent condensation of the excess steam on it's exterior bottom surface. The exterior upper surface of the chamber forms a trough which collects any condensed steam that drips from the feed ducts. The collected drippings ar reevaporated by the heated upper surface of the chamber. The feed ducts are individually adjustable so that the vacuum created across the pick-up slot can be varied. This allows creation of high vacuum regions along the pick-up slot where condensation of steam readily occurs and low vacuum regions where condensation of steam is less likely to occur.

Accordingly, it is an object of the present invention to avoid problems of existing steam shower exhaust systems by providing variable vacuum control in the cross-machine direction, while preventing dripping of water on the paper web when a steam shower is located above the web.

Another object of the present invention is to prevent water droplets that form in an exhaust duct from dripping onto the web and adversely affecting paper quality.

These and other features and objects of the present invention will be more fully understood in light of the following detailed description of the invention and accompanying drawing.

PREFERRED EMBODIMENT OF THE INVENTION

Figure 1:
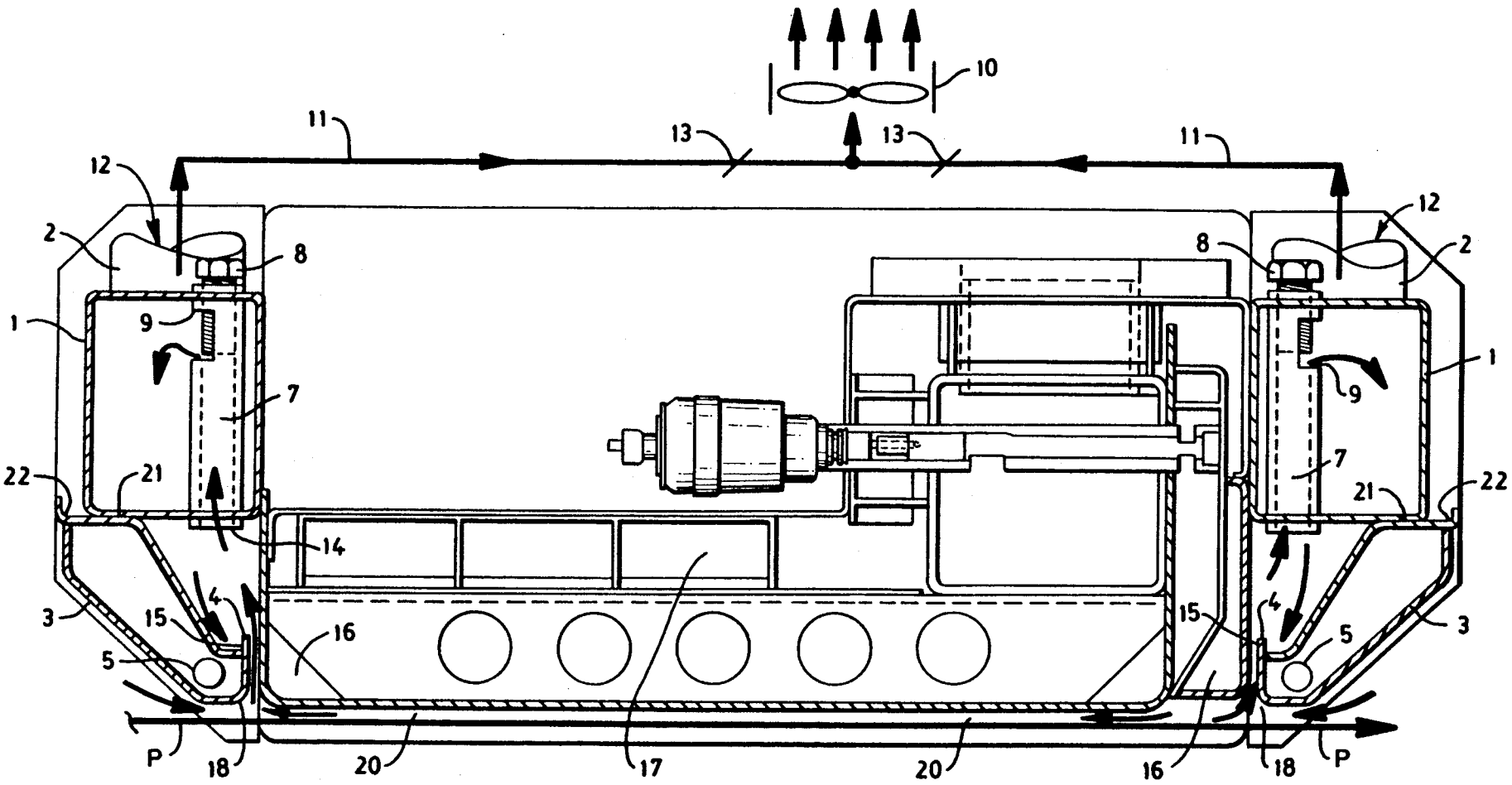
FIG. 1 is a cross-sectional view of a steam shower vacuum apparatus illustrative of an embodiment of the invention, and shown positioned above a sheet.

As illustrated in FIG. 1, the invention includes a full-width cross-machine vacuum header 1 (typically 4" wide by 6" high), which exhausts to an exhaust duct 2 of suitable dimensions located at a convenient cross-machine position. A common cross-machine sealed steam chamber 3 is attached to the vacuum header 1. Steam is supplied to the steam chamber 3 at one side of the machine (steam entry not shown) and condensate removed at the other side through a condensafe pipe 5. The use of steam (typically 10 to 15 PSIG) in the steam chamber 3 keeps the exterior surfaces of the steam chamber 3 suitably hot (typically 190° F. or higher), as required to prevent condensation of wet steam on the steam chamber exterior surfaces and formation of water droplets, which may drip on a paper web underlying the steam chamber 3.

Spaced across the machine width (typically equally spaced 6 inches apart), are steam exhaust pipes 7 which pass through the vacuum header 1 and are welded in place, top and bottom, to insure that the vacuum header 1 is sealed. Each of the steam exhaust pipes 7 is internally threaded at the top end in order to accept a flow-control bolt 8 with matching thread. The flow-control bolt 8 may be screwed in or out to adjust an open area of a flow-control slot 9 disposed in the exhaust pipe 7. The flow-control (not shown) bolt 8 may be attached to an automatic control to allow for automated adjustment. Other means, such as adjustable valves, may be used to control the vacuum at the web surface.

To operate the apparatus (which may include two (2) vacuum devices 12 as shown), a vacuum is applied to the system by an exhaust fan 10 and a suitable arrangement of ducts 11, shown schematically in FIG. 1. Typically, the vacuum duct 11 from each vacuum device 12 includes a flow-control damper 13, to independently control the over-all vacuum level for each vacuum device 12. The vacuum applied to the vacuum header 1 draws a flow of exhaust steam, proportional to the open area of the flow-control slot 9, up through a stationary vacuum pick-up slot 18, through an open bottom 14 of the exhaust pipe 7, and through the flow-control slot 9 in the exhaust pipe 7. B adjustment of the position of each independent flow-control bolt 8, the flow-control slot 9 open-area for each cross-machine segment may be controlled, as required to profile the vacuum pick-up across the machine width.

A bottom lip 4 of the steam chamber 3 is bent upward to provide a condensate trough 15. Should exhausted wet steam condense in any of the exhaust pipes 7 and drip back down into the trough 15, the heated wall of the steam chamber 3 will re-evaporate the water, thereby preventing dripping of water onto the web P. Similarly, an exterior upper surface 21 of the chamber 3 forms a trough 22 which collects any condensed steam that drips from the ducts 11. The heated upper surface 21 of the steam chamber 3 will re-evaporate condensate so collected, again, preventing dripping of water onto the web.

Finally, the vacuum apparatus includes secondary steam heated chamber(s) 16, or may be attached to a steam shower 17 that has such a heated chamber, adjacent to each vacuum pick-up slot 18, in order to insure that both sides of the vacuum pick-up slot, or nozzle, 18 are heated sufficiently to prevent condensation and dripping.

Placement of the vacuum device(s) 12 on the outboard edges of the steam shower 17 allows air entrained with the steam between the steam shower and the web which would otherwise reduce condensing heat-transfer rates and resulting steam shower efficiency, to be exhausted before it is able to enter an intended condensing space 20 and diminish overall steam shower thermal performance. In a preferred embodiment, vacuum level at the pick-up slot at least 0.01 inches of water and the pick-up slot of vacuum device is approximately 1/4 of the an inch wide.

While the foregoing vacuum apparatus has been described with reference to its preferred embodiment, various alterations and modifications will occur to those skilled in the art. For example, any means for applying a vacuum at the vacuum pick-up slot 18 may be utilized. This and other modifications are intended to fall within the scope of the claims.

What is claimed is:

1. An apparatus for removing excess steam from a web for the purpose of preventing condensation of the excess steam, the apparatus comprising:

means for creating a vacuum;

said means for creating a vacuum comprising a vacuum header and an exhaust fan for withdrawing fluid from said vacuum header;

a stationary nozzle positioned adjacent, and extending across, the web;

means for connecting said means for creating a vacuum to said nozzle;

said means for connecting said means for creating a vacuum to said nozzle comprising:

a steam exhaust pipe having an inlet at a first end thereof and a discharge orifice proximate a second end thereof;

said inlet being disposed adjacent said nozzle; and said discharge orifice being disposed in said vacuum header; and means for adjustably controlling an area of said discharge orifice which is open to said vacuum header.

2. The apparatus for removing excess steam from a web according to claim 1 wherein said means for controlling said area of said discharge orifice which is open comprises a flow control bolt.

3. An apparatus for removing excess steam from a web and preventing drippage of condensation on said web, said apparatus comprising a vacuum device extending widthwise of a web travel path in a steam shower machine and disposed so as to be proximate said web, said device having a stationary vacuum pick-up slot adjacent said web travel path, a first chamber adjacent said slot and adapted to be heated, a vacuum header adjoining said first chamber, a steam exhaust pipe extending through said header and at a first end in communication with said slot, flow control means mounted on a second end of said pipe, said pipe being provided with an opening of selectively variable size disposed in said header, said flow control means being operative to control said size of said opening, and means for maintaining a vacuum on said header and said slot.

4. The apparatus in accordance with claim 3 in which a wall of said first chamber forms a first wall of said pick-up slot.

5. The apparatus in accordance with claim 4 and including a second chamber adapted to be heated, a wall of said second chamber forming a second wall of said pick-up slot.

6. The apparatus in accordance with claim 4 in which said first chamber is adapted to receive steam and to be heated thereby.

7. The apparatus in accordance with claim 5 in which said first and second chambers are adapted to receive steam and to be heated thereby.

8. The apparatus in accordance with claim 3 in which said flow control means comprises a member at said second end of said pipe movable lengthwise of said pipe and adapted to extend across said opening in a selective manner, whereby to determine said size of said opening.

9. The apparatus in accordance with claim 8 in which said second end of said pipe is threaded and said movable member comprises a threaded bolt.

10. The apparatus in accordance with claim 3 in which a first wall of said chamber forms a first trough adapted to collect condensate for re-evaporation.

11. The apparatus in accordance with claim 10 in which said first trough underlies said pipe.

12. The apparatus in accordance with claim 11 in which a second wall of said chamber forms a second trough adapted to collect condensate for re-evaporation.

13. The apparatus in accordance with claim 12 in which said second wall comprises a top wall of said chamber.

* * * * *